US006864023B2

(12) United States Patent
Aylward et al.

(10) Patent No.: US 6,864,023 B2
(45) Date of Patent: Mar. 8, 2005

(54) IMAGING MEMBER ADHERED TO VACUOUS CORE BASE

(75) Inventors: Peter T. Aylward, Hilton, NY (US); Thomas M. Laney, Spencerport, NY (US); Robert P. Bourdelais, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/724,853

(22) Filed: Dec. 1, 2003

(65) Prior Publication Data

US 2004/0110074 A1 Jun. 10, 2004

Related U.S. Application Data

(63) Continuation-in-part of application No. 10/255,914, filed on Sep. 26, 2002.

(51) Int. Cl.[7] ..... G03C 1/765; G03C 1/795; G03C 11/02; B41J 3/407

(52) U.S. Cl. ..... 430/15; 430/14; 430/201; 430/496; 430/533; 430/536; 430/502; 347/106; 428/32.17

(58) Field of Search ..... 430/496, 14, 533, 430/15, 536, 201, 502; 347/106; 428/32.17

(56) References Cited

U.S. PATENT DOCUMENTS

| | | | |
|---|---|---|---|
| 3,579,609 | A | 5/1971 | Sevenich |
| 4,187,113 | A | 2/1980 | Mathews et al. |
| 4,355,099 | A | 10/1982 | Trautweiller |
| 4,871,784 | A | 10/1989 | Otonari et al. |
| 4,900,654 | A | 2/1990 | Pollock et al. |
| RE34,742 | E | 9/1994 | Maier et al. |
| 5,853,965 | A | 12/1998 | Haydock et al. |
| 5,866,282 | A | 2/1999 | Bourdelais et al. |
| 5,888,681 | A | 3/1999 | Gula et al. |
| 5,998,119 | A | 12/1999 | Aylward et al. |
| 6,043,009 | A | 3/2000 | Bourdelais et al. |
| 6,130,024 | A | 10/2000 | Aylward et al. |
| 6,218,059 | B1 | 4/2001 | Aylward et al. |
| 6,258,494 | B1 | 7/2001 | Bourdelais et al. |
| 6,277,547 | B1 | 8/2001 | Bourdelais et al. |
| 6,326,109 | B1 | 12/2001 | Bourdelais et al. |
| 6,344,310 | B1 | 2/2002 | Bourdelais et al. |
| 6,447,976 | B1 | 9/2002 | Dontula et al. |
| 6,465,164 | B1 | 10/2002 | Aylward et al. |
| 6,566,033 | B1 | 5/2003 | Majumdar et al. |

FOREIGN PATENT DOCUMENTS

| | | |
|---|---|---|
| EP | 1 321 807 | 6/2003 |
| WO | WO 96/12766 | 5/1996 |

*Primary Examiner*—Richard L. Schilling
(74) *Attorney, Agent, or Firm*—Paul A. Leipold

(57) ABSTRACT

This patent relates to an imaging member comprising a vacuous polymer base having adhered thereto an image formed on a transparent polymer sheet, wherein said vacuous polymer base has a density of less than 0.7 grams/cc and a modulus to density ratio of between 1500 and 4000 and wherein said image is in contact with said vacuous polymer base.

61 Claims, No Drawings

IMAGING MEMBER ADHERED TO VACUOUS CORE BASE

CROSS REFERENCE TO RELATED APPLICATIONS

This is a Continuation-in-Part of application Ser. No. 10/255,914, filed Sep. 26, 2002.

FIELD OF THE INVENTION

This invention relates to photographic materials. In a preferred form it relates to photographic reflective images.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult, requiring great care and expense to ensure proper laydown and cooling of the polyethylene layers. The formation of a suitably smooth surface would also improve image quality, as the display material would have more apparent blackness as the reflective properties of the improved base are more specular than the prior materials. As the whites are whiter and the blacks are blacker, there is more range in between and, therefore, contrast is enhanced. It would be desirable if a more reliable and improved surface could be formed at less expense.

Prior art photographic reflective papers comprise a melt extruded polyethylene layer which also serves as a carrier layer for optical brightener and other whitener materials, as well as tint materials. It would be desirable if the optical brightener, whitener materials, and tints, rather than being dispersed in a single melt extruded layer of polyethylene, could be concentrated nearer the surface where they would be more effective optically.

Prior art photographic reflective materials typically contain cellulose fiber paper to provide support for the imaging layers. While paper is an acceptable support for the imaging layers, providing a perceptually preferred feel and look to the photograph, paper does present a number of manufacturing problems which reduce the efficiency at which photographic paper can be manufactured. Problems include those such as processing chemistry penetration into the edges of the paper, paper dust as photographic paper is slit, punched and chopped, and as loss of emulsion hardening efficiency because of the moisture gradient that exists between the photographic emulsion and the paper. It would be desirable if a reflective image could be formed without the use of cellulose paper.

Prior art photographic bases are also know to contain oriented white reflective films that are adhesively adhered to a base substrate such as paper or plastic such as polyester. Such bases are coated with light sensitive silver halide photographic layers or with image receiving layers such as inkjet, thermal dye transfer and others. Typical imaging supports are disclosed in U.S. Pat. Nos. 5,866,282; 5,853,965; 5,888,681; 5,998,119; 6,043,009 and 6,218,059.

In reflective photographic papers there is a need to protect the imaging layers from scratches, fingerprints, and stains. Current photographic reflective papers use a gelatin overcoat to protect the imaging layers. While the gelatin does provide some level of protection, it can easily be scratched reducing the quality of the image. Further, fingerprints or stains caused by common household liquids such as coffee, water, or fruit juice can easily stain and distort images. Wiping the images while wet causes undesirable distortion to the gelatin overcoat. Post photographic processing equipment exists that provides a protective coating to the imaging layers. Typically consumer images are individually coated or laminated with a polymer to provide protection to the image layers. A common example is photographic identification badges that are typically laminated with a clear polymer sheet to provide protection to the image on the identification badge. Post processing application of a protective layer is expensive, as it requires an additional step in the preparation of the reflective print and additional materials to provide the overcoat. It would be desirable if a reflective photographic image could be formed with a protective coating over the developed image layers that could be efficiently applied.

Typically, photographic reflective imaging layers are coated on a polyethylene coated cellulose paper. While polyethylene coated cellulose paper does provide an acceptable support for the imaging layers, there is a need for alternate support materials such as polyester or fabric. The problem with alternate, non-paper supports is the lack of robustness in photographic processing equipment to mechanical property changes in supports. The photographic processing equipment will not run photographic materials that have significantly different mechanical properties than prior art photographic materials. It would be desirable if a reflective photographic image could be efficiently formed on alternate supports.

PROBLEM TO BE SOLVED BY THE INVENTION

There is a continuing need for imaging elements that are more durable in use and lighter weight for handling during the formation, imaging, and development process.

SUMMARY OF THE INVENTION

It is an object of the invention to overcome disadvantages of prior art and practices.

It is another object to provide photographic elements that are lightweight and thin.

These and other objects of the invention are accomplished by an imaging member comprising a vacuous polymer base having adhered thereto an image formed on a transparent polymer sheet, wherein said vacuous polymer base has a density of less than 0.7 grams/cc and a modulus to density ratio of between 1500 and 4,000 and wherein said image is in contact with said vacuous polymer base.

ADVANTAGEOUS EFFECT OF THE INVENTION

The invention provides imaging elements that are light in weight and durable.

DETAILED DESCRIPTION OF THE INVENTION

The invention has numerous advantages over prior photographic and imaging members. The members of the invention are lighter in weight so that mailing cost may be reduced. Additional the imaging member of this invention are more opaque and have much less show through than conventional imaging members. The image formed on a transparent polymer sheet after development may be easily adhered to a vacuous polymer base, thereby allowing customized use of the images on a very stiff and inexpensive substrate base member. It may be desirable for images that will be mailed to be adhered to a lightweight substrate, whereas images to be displayed can easily be adhered to a heavy substrate after their development. The imaging member generally provides a wear resistant surface on the photographic element that will not be easily damaged during handling or use of the image. The wear resistant surface provides protection from fingerprinting, spills of liquids, and other environmental deleterious exposures. The vacuous polymer base that is utilized in mounting of the images formed on a transparent polymer sheet of the invention may be lower in cost, as it is not present during development of the image and not subjected to the development chemicals in the case of a photographic imaging element. The problem of dusting during slitting and chopping of photographic elements is greatly minimized, as slitting and chopping takes place when there is no paper substrate present. The paper substrate is the primary source of dusting during slitting and chopping operations. The imaging members of the invention also are less susceptible to curl, as the gelatin containing layers are sealed from humidity contamination to a great degree. The vacuous polymer base of this invention provides a background for the image that is lighter in color appearance than other traditional imaging base members and may make the colors in the image appear brighter. Further, the transparent polymer sheet provides a barrier to oxygen, as well as water vapor at the top of the print. These and other advantages will be apparent from the detailed description below.

The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows: $T_{RGB}=10^{-D}*100$ where D is the average of the red, green, and blue Status A transmission density response measured by an X-Rite model 310 (or comparable) photographic transmission densitometer. For this invention, "reflective" print material is defined as a print material that has a spectral transmission of 15% or less.

The term used herein "vacuous polymer base" shall mean a base that has a low density that is achieved by stretching a melt cast-extruded sheet of two or more non-miscible polymers. The base contains polymer/gas voids but are different from particle voided polymer sheets in that the density obtained in vacuous base are much lower than particle voided sheets. Furthermore vacuous polymer bases of this invention are much stiffer than other voided polymer sheets at a given densities.

The term used herein "modulus to density ratio" is a ratio of the machine direction Young's modulus divided by the sample density. This measurement is done by determining the stress-strain curve of the vacuous polymer base. The tensile properties are measured using a Sintech tensile tester with a 136.4 kilogram load cell. The test conditions are 5.1 cm/min. initial jaw separation speed and 10.2 cm nominal gage length. The sample width was 15 mm.

As used herein the term "L*" is a measure of how light or dark a color is. The CIELAB metrics, a*, b*, and L*, when specified in combination, describe the color of an object, (under fixed viewing conditions, etc). The measurement of a*, b*, and L* are well documented and now represent an international standard of color measurement. (The well-known CIE system of color measurement was established by the International Commission on Illumination in 1931 and was further revised in 1971. For a more complete description of color measurement, refer to "Principles of Color Technology, 2nd Edition by F. Billmeyer, Jr. and M. Saltzman, published by J. Wiley and Sons, 1981).

L* is a measure of how light or dark a color is. L*=100 is white. L*=0 is black. The value of L* is a function of the Tristimulus value Y, thus $$L^*=116(Y/Y_n)^{1/3}-16$$

Simply stated, a* is a measure of how green or magenta the color is (since they are color opposites), and b* is a measure of how blue or yellow a color is. From a mathematical perspective, a* and b* are determined as follows:

$$a^*=500\{(X/X_n)^{1/3}-(Y/Y_n)^{1/3}\}$$

$$b^*=200\{(Y/Y_n)^{1/3}-(Z/Z_n)^{1/3}\}$$

where X, Y and Z are the Tristimulus values obtained from the combination of the visible reflectance spectrum of the object, the illuminant source (i.e. 5000° K), and the standard observer function.

The a* and b* functions determined above may also be used to better define the color of an object. By calculating the arctangent of the ratio of b*/a*, the hue-angle of the specific color can be stated in degrees.

$$h_{ab}=\arctan(b^*/a^*)$$

For the photographic member of this invention, the light sensitive emulsion layers are coated onto thin biaxially oriented transparent polymer sheet. The sheet may be provided with an emulsion adhesion layer. This photographic member can then be printed with images using conventional exposure technology and processed using traditional photographic chemistry. When the thin transparent biaxially oriented polymer sheet with the developed image is adhered to a reflective vacuous base material with the image layer on the bottom, a photographic reflective print material is created with the thin transparent biaxially oriented polymer sheet providing protection to the emulsion layer. Since the biaxially oriented polymer sheet of this invention is tough and strong, the sheet will protect the emulsion from scratches, dust, and fingerprints. Further, since the biaxially oriented polymer sheet is waterproof, it provides spill protection from liquids such as coffee, ink, and water. Protecting the emulsion has significant commercial value in that the current emulsion structure offers little protection from consumer mishandling of images.

The biaxially oriented polymer sheet is thin, preferably less than 76 micrometers. A thin biaxially oriented sheet has the advantage of allowing longer rolls of light sensitive silver halide coated rolls compared with thick cellulose paper based utilized in prior art materials. The thin polymer sheets also significantly reduce shipping cost of developed images, as the thin biaxially oriented polymer sheet of the invention weighs significantly less than prior art photographic paper. A thin sheet is also necessary to reduce unwanted reduction in the transparency of the biaxially oriented sheet, resulting in a cloudy image as the developed thin biaxially oriented sheet is laminated to a reflective support.

Another useful feature of this invention is the addition of an antihalation layer to the imaging layers. The antihalation layer prevents unwanted secondary exposure of the silver crystals in the imaging layer as light is absorbed in the antihalation layer during exposure. The prevention of secondary exposure of the light sensitive silver crystals, will significantly increase the sharpness of the image without the use of $TiO_2$ which is commonly used in prior art reflective photographic print materials.

Surprisingly, it has also been found that ultraviolet protection materials can be added to the biaxially oriented polymer sheet to provide ultraviolet protection to the couplers used in the image layer. Traditionally, this protection for prior art materials has been provided in the gelatin overcoat layer. The incorporation of the ultraviolet protection materials in the biaxially oriented polymer sheet provides better ultraviolet protection to the imaging couplers and is lower in cost, as less ultraviolet filter materials are required in the biaxially oriented sheet than in a gelatin overcoat.

By printing and developing the image on the biaxially oriented polymer sheet and then laminating to a reflective base, this invention avoids many of the problems associated with coating the light sensitive emulsions onto a paper support. Problems such as paper dusting during slitting and punching, edge penetration of processing chemicals into the exposed paper along the slit edge, and unwanted secondary reflection are caused by the paper base. Further, for prior art photographic reflective print materials, great care must be taken to ensure that the paper base does not chemically sensitize the light sensitive image layers prior to processing. By joining the imaging layers with a reflective vacuous core base after processing, a lower cost base can be used because the base material could not interact with the unexposed sensitized layers.

Any suitable thin biaxially oriented polymer sheet may be used for the transparent sheet to which the imaging layers are coated. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Polyolefins particularly polypropylene, polyethylene, polymethylpentene, and mixtures thereof are preferred. Polyolefin copolymers, including copolymers of propylene and ethylene such as hexene, butene and octene are also preferred. Polypropylenes are most preferred because they are low in cost and have good strength and surface properties.

Preferred polyesters useful to this invention include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

While it is known in the art that compatibilizers may be utilized in the formation of composite polymer materials. It has been found that the use of compatibilizers results in voided products of higher density than when compatibilizers are not utilized. It is preferred that the vacuous polymer base of the invention be substantially free of compatibilizers in order to obtain the desirable property of low density. The property of low density is desirable as it allows the imaging member to be high in opacity, have the desired backside roughness (when skin layers are not formed), and it is low in weight which results in low mailing costs.

The backside of the vacuous polymer base is white and opaque without the addition of white pigments and therefore provides a pleasing back support that is high in stiffness, white, opaque and is inexpensive. It is surprisingly found that the vacuous polymer base of this invention was superior in opacity and lighter in color than conventional photographic resin coated paper.

Addenda may be added to the vacuous backside polymer base to improve the whiteness of these sheets. This would include any process which is known in the art including adding a white pigment, such as titanium dioxide, barium sulfate, clay, or calcium carbonate. This would also include adding fluorescing agents which absorb energy in the ultraviolet region and emit light largely in the blue region, or other additives which would improve the physical properties of the sheet or the manufacturability of the sheet.

According to the present invention a process useful for the production of a vacuous polymer base comprises a blend of particles of a linear polyester with from 10 to 40% by weight of the total blend weight of particles of a homopolymer or copolymer of polyolefin, extruding the blend as a film, quenching and biaxially orienting the film by stretching it in mutually perpendicular directions, and heat setting the film.

The opacity of the resulting vacuous polymer base arises through voiding which occurs between the regions of the linear polyester and the propylene polymer during the stretching operation. The linear polyester component of the vacuous polymer base may consist of any thermoplastic film forming polyester which may be produced by condensing one or more dicarboxylic acids or a lower alkyl diester thereof, e.g. terephthalic acid, isophthalic, phthalic, 2,5-, 2,6- or 2,7-naphthalene dicarboxylic acid, succinic acid, sebacic acid, adipic acid, azelaic acid, bibenzoic acid, and hexahydroterephthalic acid, or bis-p-carboxy phenoxy ethane, with one or more glycols, e.g. ethylene glycol, 1,3-propanediol, 1-4-butanediol, neopentyl glycol and 1,4-cyclohexanedimethanol. It is to be understood that a copolyester of any of the above materials may be used. The preferred polyester is polyethylene terephthalate.

The preferred polyolefin additive which is blended with the polyester is a homopolymer or copolymer of propylene. Generally a homopolymer produces adequate opacity in the vacuous polymer and it is preferred to use homopolypropylene. An amount of 10 to 40% by weight of polyolefin additive, based on the total weight of the blend, is used. Amounts less than 10% by weight based on the total weight of the blend do not produce an adequate opacifying effect. Increasing the amount of polyolefin additive causes the tensile properties, such as tensile yield and break strength, modulus and elongation to break, to deteriorate and it has been found that amounts generally exceeding 40% by weight based on the total weight of the blend can lead to film splitting during production. Satisfactory opacifying and tensile properties can be obtained with up to 35% by weight based on the total weight of the blend of polyolefin additive.

The polyolefin additive used according to this invention is incompatible with the polyester component of the vacuous polymer base and exists in the form of discrete globules dispersed throughout the oriented and heat set vacuous polymer base. The opacity of the vacuous polymer base is produced by voiding which occurs between the additive globules and the polyester when the vacuous polymer base is stretched. It has been discovered that the polymeric additive must be blended with the linear polyester prior to extrusion through the film forming die by a process which results in a loosely blended mixture and does not develop an intimate bond between the polyester and the polyolefin additive.

Such a blending operation preserves the incompatibility of the components and leads to voiding when the vacuous polymer base is stretched. A process of dry blending the polyester and polyolefin additive has been found to be useful. For instance, blending may be accomplished by mixing finely divided, e.g. powdered or granular, polyester and polymeric additive and, thoroughly mixing them together, e.g. by tumbling them. The resulting mixture is then fed to the film forming extruder. Blended polyester and polymeric additive which has been extruded and, e.g. reduced to a granulated form, can be successfully re-extruded into a vacuous opaque voided film (vacuous polymer base). It is thus possible to re-feed scrap film, e.g. as edge trimmings, through the process. Alternatively, blending may be effected by combining melt streams of polyester and the polyolefin additive just prior to extrusion. If the polymeric additive is added to the polymerization vessel in which the linear polyester is produced, it has been found that voiding and hence opacity is not developed during stretching. This is thought to be on account of some form of chemical or physical bonding which may arise between the additive and polyester during thermal processing.

The extrusion, quenching and stretching of the vacuous polymer base may be effected by any process which is known in the art for producing oriented polyester film, e.g. by a flat film process or a bubble or tubular process. The flat film process is preferred for making vacuous polymer base according to this invention and involves extruding the blend through a slit die and rapidly quenching the extruded web upon a chilled casting drum so that the polyester component of the film is quenched into the amorphous state. The film base is then biaxially oriented by stretching in mutually perpendicular directions at a temperature above the glass-rubber transition temperature of the polyester. Generally the film is stretched in one direction first and then in the second direction although stretching may be effected in both directions simultaneously if desired. In a typical process the film is stretched firstly in the direction of extrusion over a set of rotating rollers or between two pairs of nip rollers and is then stretched in the direction transverse thereto by means of a tenter apparatus. The film may be stretched in each direction to 2.5 to 4.5 times its original dimension in the direction of stretching. After the film has been stretched and a vacuous polymer base formed, it is heat set by heating to a temperature sufficient to crystallize the polyester whilst restraining the vacuous polymer base against retraction in both directions of stretching. The voiding tends to collapse as the heat setting temperature is increased and the degree of collapse increases as the temperature increases. Hence the light transmission increases with an increase in heat setting temperatures. Whilst heat setting temperatures up to about 230 C. can be used without destroying the voids, temperatures below 200° C. generally result in a greater degree of voiding and higher opacity.

The opacity as determined by the total luminous transmission of a vacuous polymer base depends upon the thickness of the vacuous polymer base. Thus the stretched and heat set vacuous polymer base made according to this invention have a total luminous transmission not exceeding 25%, preferably not exceeding 20%, for vacuous polymer base having a thickness of at least 100 micrometers, when measured by ASTM test method D-1003-61, vacuous polymer base of thickness 50 to 99 micrometers have a total luminous transmission generally up to 30%. The invention also therefore relates to opaque biaxially oriented and heat set vacuous polymer bases produced from a blend of a linear polyester and from 10 to 40% by weight of a homopolymer or copolymer of ethylene or propylene and having a total luminous transmission of up to 30%. Such vacuous polymer bases may be made by the process specified above. The globules of polymeric additive distributed throughout the film produced according to this invention are generally 5 to 50 micrometer in diameter and the voids surrounding the globules 3 to 4 times the actual diameter of the globules. It has been found that the voiding tends to collapse when the void size is of the order of the vacuous polymer base thickness. Such vacuous polymer base therefore tends to exhibit poor opacity because of the smaller number of void surfaces at which light scattering can occur. Accordingly it is therefore preferred that the vacuous polymer base of this invention should have a thickness of at least 25 microns. vacuous polymer base thicknesses of between 100 and 250 micrometers are convenient for most end uses. Because of the voiding, the vacuous polymer bases with a density of less than 0.7 gm/cc is lighter in weight, and more resilient than those bases with higher densities. More resilient refers to the vacuous base's ability to bend and comply with various forms and shapes without cracking or damaging the base. Furthermore the vacuous base may be put under compressive loads, and it has the ability to bounce back to it original thickness. In a preferred embodiment of this invention the vacuous base has a density of between 0.3 and 0.7 gm/cc for good strength and smoothness. Bases with a density below 0.3 gm/cc are difficult to make because they generally are very weak and are prone to breaks. Additionally it is difficult to make bases below 0.3 gm/cc that have sufficient surface smoothness for images. It is preferred that the density of the vacuous base be between 0.3 and 0.5 gm/cc for good strength and very light weight.

It may be possible to provide additional smoothing layers to low density bases to make them acceptable for imaging.

The vacuous polymer bases may contain any compatible additive, such as pigments. Thus a light reflecting pigment, such as titanium dioxide, may be incorporated to improve the appearance and whiteness of the vacuous polymer bases. The vacuous polymer base may be used in any of the applications for which polyethylene terephthalate is used, except of course those where a high degree of transparency is required.

The vacuous polymer bases of this invention exhibit a remarkable paper-like texture and are therefore suitable for use as a paper substitute, in particular as a base for photographic prints, i.e. as a substitute for photographic printing paper.

The quenching, orienting, and heat setting of vacuous polymer base may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining, to some degree, the sheet against retraction in both directions of stretching.

The vacuous polymer base may additionally have a topmost skin layer beneath the imaging layers or exposed surface layer that is between 0.20 $\mu$m and 1.5 $\mu$m, preferably between 0.5 and 1.0 $\mu$m thick. Below 0.5 $\mu$m any inherent non-planarity in the coextruded skin layer may result in unacceptable color variation. At skin thickness greater than 1.0 $\mu$m, there is little benefit in the photographic optical properties such as image resolution. At thickness greater that 1.0 $\mu$m, there is also a greater material volume to filter for contamination such as clumps, poor color pigment dispersion, or contamination. The skin material may include polyester and copolymers thereof as well as polyolefins and copolymer or blends thereof.

Addenda may be added to the topmost skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been preblended at the desired blend ratio. Colored pigments that can resist extrusion temperatures greater than 275° C. are preferred, as temperatures greater than 275° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, Irgalite organic blue pigments, and pigment Blue 60.

The imaging member of this invention has vacuous polymer base with a density of less than 0.7 grams/cc and a modulus to density ratio of between 1500 and 4,000 which is adhered to a transparent polymer base that has an image. The preferred modulus to density range of the vacuous polymer base is between 2,000 and 3600. Below 2,000 the vacuous polymer base is weak and does not provide sufficient strength or bending resistant and in general feels limp. Above 4,000 the vacuous polymer base is not sufficiently opaque for viewing imaging without show through. Additional vacuous base above 3600 are more expensive.

In the formation of the imaging member of this invention it is preferred that the vacuous polymer base has a stiffness of between 50 and 300 millinewtons. Below 50 millinewtons that imaging member does not feel substantial enough to provide the viewer with a sense of worth. While imaging member above 300 millinewtons are sufficiently stiff, the added cost provides little or no benefit. Additionally excessively stiff imaging member are more difficult for the end user to handle and are not sufficiently pliable to use is albums. Imaging members above 300 millinewtons tend to become very thick and are difficult to place in picture frames.

The vacuous polymer base useful in the imaging element of this invention is preferably a composite of polyolefin and polyester having a ratio of polyester to polyolefin of between 5:1 and 11:9 by weight. Ratios above 5:1 do not void properly and tend to be low in opacity and high in density while ratios below 11:9 are not robust in manufacturing due to tear outs during stretching resulting in very low yields.

The preferred vacuous polymer base useful in the imaging element of this invention is a composite blend of polyolefin and polyester having a ratio of polyester to polyolefin of between 4:1 and 13:7 by weight. Ratios above 4:1 are more polyester like and are more difficult to void, while ratios below 13:7 are harder to control for voiding and generally require tight control of the process conditions.

In the formation of imaging elements of this invention it is highly desirable to have a vacuous polymer base that has a L* of greater than 93. L* greater than 93 are much lighter and generally whiter appearing and therefore are more pleasing to the viewer. Below 93 the vacuous base is dark appearing and does not provide bright appearing colors.

The preferred imaging member of this invention has a vacuous polymer base that has a spectral transmission of less than 10%. Vacuous bases with transmissions of less than 10% provide sufficient opacity to minimize show through. It is preferred that the vacuous bases have as low a spectral transmission as possible. It has been found that the vacuous polymer base of the invention may be formed with a spectral transmission of between 5 and 8% while maintaining opacity and excellent mechanical properties. These low spectral transmission rates are achieved without the use of prior art compatibilizer materials which yielded much higher spectral transmission values. If print have writing or back logos on the backside of the print, base with low opacity will have show through and interfere with the image. In such cases the viewer perceives this prints to be low in quality and low in value.

Since the image that is formed is on a transparent polymer sheet and the vacuous polymer base is adhered to the transparent polymer sheet side or the image side of said imaged polymer sheet, it may be desirable to coat the vacuous polymer base with an adhesive layer and form an imaging member by joining the imaged transparent polymer sheet with the adhesive coated vacuous polymer base. This provides a quick and convenient means of attaching the vacuous polymer base to the formed image. Having the adhesive on the vacuous polymer base does not interfere with the image formation and in the case of a photographic image that requires chemical process the adhesive does not contaminate the process chemicals. In another case, an adhesive layer may be applied to either side of the imaged transparent polymer sheet and then attached to the vacuous polymer base. In both these cases a light weight, highly resilient, opaque base is attached to an image to form a substantially thick, please base of display or customer viewing.

In the present invention the vacuous polymer base is preferably provided with an integral skin layer adapted for adhesion to said image. Such a layer is desirable for quick attachment to the image. Furthermore the integral layer may have a polymer having a Tg of less than 60° C. Polymers with a Tg less than 60° C. provide a surface and material that more readily attaches to the image. It is preferred to have a polymer having a Tg of between 45 and 55° C. Polymers below 45° C. tend to soften too quickly and are difficult to work with while polymers above 55° C. require more effort to soften and adhere to the image.

It has been found that the use of compatibilizers when forming blended voided polymers results in higher densities indicating less voiding. It is desirable that the vacuous materials of the invention have low density and therefore greater voiding and less spectral transmission. In particular the blend of polyester with polypropylene is particularly successful in forming low density vacuous materials when the composition is substantially free of compatibilizers. As utilized herein substantially free of compatibilizers means that compatibilizer is present in an amount of less than 0.5 wt % of the polymer. The polymer blend being free of compatibilizer also has the advantages that compounding and manufacturing complexities area avoided and the cost of the compatibilizer is not necessary. As used herein the term compatibilizer means a polymeric material that narrows the size distribution of the discrete phase of one of the components of the vacuous base. For example, the compatibilizer would be a polymeric material that narrows the size distribution of the thermal plastic olefin phase of the vacuous base material.

In a preferred embodiment of invention the imaging member has a vacuous polymer base that has a conductive surface. Providing a conductive layer helps to minimize static buildup. Minimizing static buildup helps to prevent the sheets from sticking together due to static cling. Furthermore static buildup attracts dirt which can create problems when adhering the vacuous polymer base to the imaged transparent polymer sheet. Dirt between the base and imaged sheet creates an undesirable and objectionable print. In another preferred embodiment of this invention the vacuous polymer base has an integrally extruded conductive skin layer. An integral extruded layer is desirable because the vacuous base can be made in a one step operation that is lower in cost but also minimizes the opportunity of the base from being scratched.

In a further preferred embodiment of this invention the imaging member, the vacuous polymer base is provided with a polyester skin layer. A polyester skin is desirable to provide a smoother surface than achievable with the blend of two polymers. In the preferred embodiment said vacuous polymer base has a surface in contact with said image having a roughness of less than 0.2 micrometers. This is beneficial in obtaining better adhesion between the top surface of the vacuous polymer base and the image layer. Such a smooth surface also minimizes any surface non-uniformities that may detract from the print appearance. In a further embodiment said the imaging member has vacuous polymer base has a surface in contact with said image having a roughness of between 0.09 and 0.20 micrometers. Above 2.0 micrometers the surface formed may interfere with print viewing while below 0.09 micrometers air bubbles may become a problems when adhere the imaged transparent sheet and the vacuous polymer sheet together.

In a preferred imaging member of this invention the vacuous polymer base has a surface roughness on the side of said vacuous polymer base opposite to said image of between 0.25 and 2.0 micrometers. In most imaging print materials it is desirable to have a degree of roughness. Below 0.25 micrometers the outer most back surface is too smooth and does not have a print like feel to it. Furthermore if the surface is too smooth, it is prone to scratching and may also cause problems in conveyance during the process of joining the top imaged transparent polymer layer and the vacuous polymer base. Above 2.0 micrometers the surface has excessive roughness that may cause damage to the final assembled imaging member. In another embodiment of this invention the roughness of between 0.25 and 2.0 may be obtained without the use of additive particles. This may be achieved by embossing a pattern into the surface of the backside or by melt coating the backside surface with a layer of polymer that is extruded onto the vacuous polymer base by bringing the base and molten resin together in a nip of two rollers that is under mechanical pressure. One of the rollers is preferable a chill roll that has a roughened surface that replicates its surface into the resin that was extruded onto the base. An additional means of providing the desired roughness is to laminate a sheet to the backside surface that has the desired roughness. This is preferable a polymer sheet but may also be paper, fabric or cloth.

In yet another embodiment of this invention said vacuous polymer base further comprises white pigment. White pigment is useful in providing additional opacity particularly when thin vacuous polymer bases are used or where the amount of voiding is not sufficient to prevent show through by itself. White pigment is also useful in providing additional whiteness to the imaging member. Any white pigment known in the art may be use such as $TiO_2$, $BaSo_4$, $CaCO_3$, clays, talc, and others.

When making imaged print materials it is also desirable to mark or otherwise record or write on the imaging materials. In a further embodiment the imaging member in which the vacuous polymer base whose side opposite the image further comprises a surface layer of a low Tg polymer having a Tg of less than 60° C. and has indicia embossed thereon. This is useful in being able to record information about the print on the print surface.

In a further embodiment said vacuous polymer base may comprise a magnetic recordable layer integral with said vacuous polymer base on the side opposite said image. A magnetic recording layer are useful in capturing digital information about the processing or printing condition of the print as well as the exposure information when the image was capture or where the image came from.

In the area of commercial display it is desirable to provide imaged materials that are fire retardant in order to meet fire code. In an embodiment of this invention the imaging member comprising a vacuous polymer base further comprises a fire retardant material.

Materials and means of providing the vacuous polymer base of this invention with fire retardant properties include at least one fire retardant material selected from the group consisting of phosphoric acid esters, aryl phosphates and their alkyl substituted derivatives, phosphorinanes, antimony trioxide, aluminum hydroxide, boron-containing compounds, chlorinated hydrocarbons, chlorinated cycloaliphatics, aromatically bound bromine compounds and halogen-containing materials. These materials may be useful in providing a vacuous polymer base that is more resistant to flame than other plastic or paper bases. Since these imaging members may be used for display purposes, it is beneficial to have display that meet strict new fire codes. The phosphoric acid esters and in particular phosphorinanes are preferred because they may be added to the polymer base resin with minimal coloration effect to the polymer base.

Since the vacuous polymer base of this invention has high opacity, the imaging member that is formed with a transparent polymer sheet with an image may be adhered to both sides of said vacuous sheet. In this embodiment a single sheet of vacuous base is needed to display two images. This is useful for album pages. The image that is adhered to the polymer base may be further wrapped around an edge of the vacuous polymer base. This is useful in the production of print material. Two or more images may be made or developed on the transparent polymer sheet that is then adhered to the vacuous core. The imaged transparent polymer base is wrapped around at least one edge of the vacuous core base. This is a cost effective means of making imaging member. In a further embodiment of this invention the imaging member is provided with a means to aid in the insertion into an album. The most preferred means of this embodiment is provide holes. Holes are useful for use in ring binders or with use of spiral fasteners. Any means know in the art of binding or otherwise holding two or more sheets together may be used.

An additional embodiment of this invention comprises an imaging member with a vacuous polymer base that is provided on each side with an integral skin layer adapted for adhesion to said image. The integral skin layer may have a polymer having a Tg of less than 60° C. Polymers with a Tg less than 60° C. are desirable because they generally may be adapted for adhesion more easily. Any polymer known in the art may be used provided that when it is adapted it provides an adhesive force between the transparent polymer sheet with an image to the vacuous core base. Some useful polymers include pressure sensitive adhesives and thermal sensitive polymers whose adhesive properties are activated by the application of heat and or pressure. This may also include encapsulated materials that when pressure is applied, the capsule is broken and an adhesive bond is formed. An additional means of forming the imaging member is to insert a sheet of material between the transparent polymer sheet with the image and the vacuous core base. When heat and or pressure is applied an adhesive force is formed to hold the said transparent polymer sheet and vacuous core base together.

In the formation of imaging members it is often desirable to record information with the image. In one embodiment of this invention the imaging member with the vacuous polymer base is further provided with an ink jet receiving layer on the side of said vacuous polymer base opposite to said image. Having an ink jet receiving layer on the backside of the imaging member is useful to record information about the image or even to provide an inkjet formed image on the backside. In a further embodiment of this invention said ink jet receiving layer may comprise a voided polyester. In this embodiment the voided polyester is an open cell layer that is capable of accepting ink. Such a ink jet receiving layer is useful because it may be formed integrally with the vacuous polymer base and therefore not require a separate manufacturing step to apply it to vacuous polymer base.

In a further embodiment of this invention the imaging member where said image adhered to a transparent polymer sheet comprises an image formed utilizing photosensitive silver halide and dye forming couplers. Photosensitive silver halide and dye forming couplers are useful in forming images of very high quality. Such images may be formed optically or by digital exposure of silver halide containing materials. In further embodiments of this invention the imaged formed on the transparent polymer sheet may be formed by inkjet printing or by thermal dye transfer. Such images provide pleasing images and good value to the end user. Additionally the image on the transparent polymer sheet may be made by other imaging technique such as electrophotography.

Ink jet printing is a non-impact method for producing images by the deposition of ink droplets in a pixel-by-pixel manner to an image-recording element in response to digital signals. There are various methods which may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to an ink sump. In another process, known as drop-on-demand ink jet, individual ink droplets are projected as needed onto the image-recording element to form the desired image. Common methods of controlling the projection of ink droplets in drop-on-demand printing include piezoelectric transducers and thermal bubble formation. Ink jet printers have found broad applications across markets ranging from industrial labeling to short run printing to desktop document and pictorial imaging.

The inks used in the various ink jet printers can be classified as either dye-based or pigment-based. A dye is a colorant which is molecularly dispersed or solvated by a carrier medium. The carrier medium can be a liquid or a solid at room temperature. A commonly used carrier medium is water or a mixture of water and organic co-solvents. Each individual dye molecule is surrounded by molecules of the carrier medium. In dye-based inks, no particles are observable under the microscope. Although there have been many recent advances in the art of dye-based ink jet inks, such inks still suffer from deficiencies such as low optical densities on plain paper and poor light-fastness. When water is used as the carrier medium, such inks also generally suffer from poor water-fastness.

An ink jet recording element typically comprises a support having on at least one surface thereof an ink-receiving or image-forming layer. The ink-receiving layer may be a polymer layer which swells to absorb the ink or a porous layer which imbibes the ink via capillary action.

Ink jet prints, prepared by printing onto ink jet recording elements, are subject to environmental degradation. They are especially vulnerable to water smearing, dye bleeding, coalescence and light fade. For example, since ink jet dyes are water-soluble, they can migrate from their location in the image layer when water comes in contact with the receiver after imaging. Highly swellable hydrophilic layers can take an undesirably long time to dry, slowing printing speed, and will dissolve when left in contact with water, destroying printed images. Porous layers speed the absorption of the ink vehicle, but often suffer from insufficient gloss and severe light fade.

A binder may also be employed in the image-receiving layer in the invention. In a preferred embodiment, the binder is a hydrophilic polymer. Examples of hydrophilic polymers useful in the invention include poly(vinyl alcohol), polyvinylpyrrolidone, poly(ethyl oxazoline), poly-N-vinylacetamide, non-deionized or deionized Type IV bone gelatin, acid processed ossein gelatin, pig skin gelatin, acetylated gelatin, phthalated gelatin, oxidized gelatin, chitosan, poly(alkylene oxide), sulfonated polyester, partially hydrolyzed poly(vinyl acetate-co-vinyl alcohol), poly (acrylic acid), poly(1-vinylpyrrolidone), poly(sodium styrene sulfonate), poly(2-acrylamido-2-methane sulfonic acid), polyacrylamide or mixtures thereof. In a preferred embodiment of the invention, the binder is gelatin or poly (vinyl alcohol).

If a hydrophilic polymer is used in the image-receiving layer, it may be present in an amount of from about 0.02 to about 30 g/m$^2$, preferably from about 0.04 to about 16 g/m$^2$ of the image-receiving layer.

Latex polymer particles and/or inorganic oxide particles may also be used as the binder in the image-receiving layer to increase the porosity of the layer and improve the dry time. Preferably the latex polymer particles and/or inorganic oxide particles are cationic or neutral. Examples of inorganic oxide particles include barium sulfate, calcium carbonate, clay, silica or alumina, or mixtures thereof. In that case, the weight % of particulates in the image receiving layer is from about 80 to about 95%, preferably from about 85 to about 90%.

The pH of the aqueous ink compositions employed in the invention may be adjusted by the addition of organic or inorganic acids or bases. Useful inks may have a preferred pH of from about 2 to 10, depending upon the type of dye being used. Typical inorganic acids include hydrochloric, phosphoric and sulfuric acids. Typical organic acids include methanesulfonic, acetic and lactic acids. Typical inorganic bases include alkali metal hydroxides and carbonates. Typical organic bases include ammonia, triethanolamine and tetramethylethlenediamine.

A humectant is employed in the ink jet composition employed in the invention to help prevent the ink from drying out or crusting in the orifices of the printhead. Examples of humectants which can be used include polyhydric alcohols, such as ethylene glycol, diethylene glycol, triethylene glycol, propylene glycol, tetraethylene glycol, polyethylene glycol, glycerol, 2-methyl-2,4-pentanediol 1,2, 6-hexanetriol and thioglycol; lower alkyl mono- or di-ethers derived from alkylene glycols, such as ethylene glycol mono-methyl or mono-ethyl ether, diethylene glycol mono-methyl or mono-ethyl ether, propylene glycol mono-methyl or mono-ethyl ether, triethylene glycol mono-methyl or mono-ethyl ether, diethylene glycol di-methyl or di-ethyl ether, and diethylene glycol monobutylether; nitrogen-containing cyclic compounds, such as pyrrolidone, N-methyl-2-pyrrolidone, and 1,3-dimethyl-2-imidazolidinone; and sulfur-containing compounds such as dimethyl sulfoxide and tetramethylene sulfone. A preferred humectant for the composition employed in the invention is diethylene glycol, glycerol, or diethylene glycol monobutylether.

Water-miscible organic solvents may also be added to the aqueous ink employed in the invention to help the ink penetrate the receiving substrate, especially when the substrate is a highly sized paper. Examples of such solvents include alcohols, such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofurfuryl alcohol; ketones or ketoalcohols such as acetone, methyl ethyl ketone and diacetone alcohol; ethers, such as tetrahydrofuran and dioxane; and esters, such as, ethyl lactate, ethylene carbonate and propylene carbonate.

Surfactants may be added to adjust the surface tension of the ink to an appropriate level. The surfactants may be anionic, cationic, amphoteric or nonionic.

A biocide may be added to the composition employed in the invention to suppress the growth of microorganisms such as molds, fungi, etc. in aqueous inks. A preferred biocide for the ink composition employed in the present invention is Proxel® GXL (Zeneca Specialties Co.) at a final concentration of 0.0001–0.5 wt. %.

A typical ink composition employed in the invention may comprise, for example, the following substituents by weight: colorant (0.05–5%), water (20–95%), a humectant (5–70%), water miscible co-solvents (2–20%), surfactant (0.1–10%), biocide (0.05–5%) and pH control agents (0.1–10%).

Additional additives which may optionally be present in the ink jet ink composition employed in the invention include thickeners, conductivity enhancing agents, anti-kogation agents, drying agents, and defoamers.

The ink jet inks employed in this invention may be employed in ink jet printing wherein liquid ink drops are applied in a controlled fashion to an ink receptive layer substrate, by ejecting ink droplets from a plurality of nozzles or orifices of the print head of an ink jet printer.

The image-recording layer used in the process of the present invention can also contain various known additives, including matting agents such as titanium dioxide, zinc oxide, silica and polymeric beads such as crosslinked poly (methyl methacrylate) or polystyrene beads for the purposes of contributing to the non-blocking characteristics and to control the smudge resistance thereof; surfactants such as non-ionic, hydrocarbon or fluorocarbon surfactants or cationic surfactants, such as quaternary ammonium salts; fluorescent dyes; pH controllers; anti-foaming agents; lubricants; preservatives; viscosity modifiers; dye-fixing agents; waterproofing agents; dispersing agents; UV- absorbing agents; mildew-proofing agents; mordants; antistatic agents, anti-oxidants, optical brighteners, and the like. A hardener may also be added to the ink-receiving layer if desired.

The dye receiving layer or DRL for ink jet imaging may be applied by any known methods. Such as solvent coating, or melt extrusion coating techniques. The DRL is coated over the TL at a thickness ranging from 0.1–10 um, preferably 0.5–5 um. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al., in U.S. Pat. Nos. 4,879,166, 5,14,730, 5,264,275, 5,104,730, 4,879,166, and Japanese patents 1,095,091, 2,276,671, 2,276,670, 4,267,180, 5,024, 335, 5,016,517, discloses aqueous based DRL formulations comprising mixtures of psuedo-bohemite and certain water soluble resins. Light, in U.S. Pat. Nos. 4,903,040, 4,930,041, 5,084,338, 5,126,194, 5,126,195, 5,139,8667, and 5,147, 717, discloses aqueous-based DRL formulations comprising mixtures of vinyl pyrrolidone polymers and certain water-dispersible and/or water-soluble polyesters, along with other polymers and addenda. Butters, et al., in U.S. Pat. Nos. 4,857,386, and 5,102,717, disclose ink-absorbent resin layers comprising mixtures of vinyl pyrrolidone polymers and acrylic or methacrylic polymers. Sato, et al., in U.S. Pat. No. 5,194,317, and Higuma, et all., in U.S. Pat. No. 5,059,983, disclose aqueous-coatable DRL formulations based on poly (vinyl alcohol). Iqbal, in U.S. Pat. No. 5,208,092, discloses water-based IRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is a 0.1–10 um DRL which is coated as an aqueous dispersion of 5 parts alumoxane and 5 parts poly (vinyl pyrrolidone). The DRL may also contain varying levels and sizes of matting agents for the purpose of controlling gloss, friction, and/or finger print resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118, 5,027,131, and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560 C printer. However, it is intended that alternative embodiments of the image-recording elements as described above, which may be formulated for use with inks which are specific to a given ink-recording process or to a given commercial vendor, fall within the scope of the present invention.

The thermal dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process, a photosensitive element is permanently imaged to form areas of differential conductivity. Uniform electrostatic charging, followed by differential discharge of the imaged element, creates an electrostatic image. These elements are called electrographic or xeroprinting masters because they can be repeatedly charged and developed after a single imaging exposure.

In an alternate electrographic process, electrostatic images are created iono-graphically. The latent image is created on dielectric (charge-holding) medium, either paper, vacuous polymer base or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent these toners form a film bonded to the vacuous polymer base. For heat-fusible toners, thermoplastic polymers are used as part of the particle. Heating both removes residual liquid and fixes the toner to vacuous polymer base.

The photosensitive silver halide dye forming coupler layers used in this invention are described in *Research Disclosure*, September 1994, Item 36544, Section I, published by Kenneth Mason Publications, Ltd., Dudley Annex, 12a North Street, Emsworth, Hampshire PO10 7DQ, ENGLAND.

As used herein, the phrase "photographic element" is a material that utilizes photosensitive silver halide in the formation of images. The photographic elements are full color elements. Full color elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film-forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

EXAMPLE 1

In this example the photographic element was constructed utilizing a two-layer biaxially oriented polyolefin sheet to which a standard photographic paper light sensitive silver halide emulsion was coated. The light sensitive silver halide emulsion was coated on the polyethylene skin. The photographic element was then printed with various images and the images were developed using standard photographic paper wet chemistry processing. To create a reflective print, the developed image on the thin biaxially oriented sheet was then laminated to a vacuous polymer base using a pressure adhesive. This example will show the significant improvement in image durability and image quality compared to standard photographic reflective paper. Further, because the vacuous polymer base was added after the image was formed, the expense of manufacturing and developing images on a paper base was avoided.

The biaxially oriented polyolefin sheet used in this example was a biaxially oriented, two side corona discharge treated polypropylene sheet (18 μm thick) (density=0.90 g/cc) consisting of a solid polypropylene layer (17 μm thick) and a polyethylene skin (1 μm thick). Blue pigment 60 (0.12% by weight of polyethylene) and Hostulux KS optical brightener (0.20% by weight of polyethylene) were added to the polyethylene skin.

Coating format 1 described below, which contains a gray silver used for antihalation in the SOC layer, was then coated on the polyethylene skin layer. Silver chloride emulsions were chemically and spectrally sensitized as described below. A biocide comprising a mixture of N-methyl-isothiazolone and N-methyl-5-chloro-isthiazolone was added after sensitization.

Blue Sensitive Emulsion (Blue EM-1). A high chloride silver halide emulsion is precipitated by adding approximately equimolar silver nitrate and sodium chloride solutions into a well-stirred reactor containing glutaryldiaminophenyldisulfide, gelatin peptizer, and thioether ripener. Cesium pentachloronitrosylosmate(II) dopant is added during the silver halide grain formation for most of the precipitation, followed by the addition of potassium hexacyanoruthenate(II), potassium (5-methyl-thiazole)-pentachloroiridate, a small amount of KI solution, and shelling without any dopant. The resultant emulsion contains cubic-shaped grains having edge length of 0.6 μm. The emulsion is optimally sensitized by the addition of a colloidal suspension of aurous sulfide and heat ramped to 60° C., during which time blue sensitizing dye BSD-4, potassium hexchloroiridate, Lippmann bromide, and 1-(3-acetamidophenyl)-5-mercaptotetrazole were added.

Green Sensitive Emulsion (Green EM-1): A high chloride silver halide emulsion is precipitated by adding approximately equimolar silver nitrate and sodium chloride solutions into a well-stirred reactor containing gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic-shaped grains of 0.3 μm in edge length size. The emulsion is optimally sensitized by the addition of glutaryldiaminophenyldisulfide, a colloidal suspension of aurous sulfide and heat ramped to 55° C., during which time potassium hexachloroiridate doped Lippmann bromide, a liquid crystalline suspension of green sensitizing dye GSD- 1, and 1-(3-acetamidophenyl)-5-mercaptotetrazole were added.

Red Sensitive Emulsion (Red EM-1): A high chloride silver halide emulsion is precipitated by adding approximately equimolar silver nitrate and sodium chloride solutions into a well-stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 μm in edge length size. The emulsion is optimally sensitized by the addition of glutaryldiaminophenyldisulfide, sodium thiosulfate, tripotassium bis{2-[3-(2-sulfobenzamido)phenyl]-mercaptotetrazole} gold(I) and heat ramped to 64° C., during which time 1-(3-acetamidophenyl)-5-mercaptotetrazole, potassium hexachloroiridate, and potassium bromide are added. The emulsion is then cooled to 40° C., pH adjusted to 6.0, and red sensitizing dye RSD-1 is added. Silver chloride emulsions were chemically and spectrally sensitized as described below. A biocide comprising a mixture of N-methyl-isothiazolone and N-methyl-5-chloroisthiazolone was added after sensitization.

Blue Sensitive Emulsion (Blue EM-1). A high chloride silver halide emulsion is precipitated by adding approximately equimolar silver nitrate and sodium chloride solutions into a well-stirred reactor containing glutaryldiaminophenyldisulfide, gelatin peptizer, and thioether ripener. Cesium pentachloronitrosylosmate(II) dopant is added during the silver halide grain formation for most of the precipitation, followed by the addition of potassium hexacyanoruthenate(II), potassium (5-methyl-thiazole)-pentachloroiridate, a small amount of KI solution, and shelling without any dopant. The resultant emulsion contains cubic-shaped grains having edge length of 0.6 μm. The emulsion is optimally sensitized by the addition of a colloidal suspension of aurous sulfide and heat ramped to 60° C., during which time blue sensitizing dye BSD-4, potassium hexchloroiridate, Lippmann bromide, and 1-(3-acetamidophenyl)-5-mercaptotetrazole were added.

Green Sensitive Emulsion (Green EM-1): A high chloride silver halide emulsion is precipitated by adding approximately equimolar silver nitrate and sodium chloride solutions into a well-stirred reactor containing gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic-shaped grains of 0.3 μm in edge length size. The emulsion is optimally sensitized by the addition of glutaryldiaminophenyldisulfide, a colloidal suspension of aurous sulfide and heat ramped to 55° C., during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1): A high chloride silver halide emulsion is precipitated by adding approximately equimolar silver nitrate and sodium chloride solutions into a well-stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 μm in edge length size. The emulsion is optimally sensitized by the addition of glutaryldiaminophenyldisulfide, sodium thiosulfate, tripotassium bis{2-[3-(2-sulfobenzamido)phenyl]-mercaptotetrazole} gold(I) and heat ramped to 64° C., during which time 1-(3-acetamidophenyl)-5-mercaptotetrazole, potassium hexachloroiridate, and potassium bromide are added. The emulsion is then cooled to 40° C., pH adjusted to 6.0, and red sensitizing dye RSD-1 is added.

The following flesh tone optimized light sensitive silver halide imaging layers were utilized to prepare photographic label utilizing the invention label base material. The following imaging layers were coated utilizing curtain coating:

| Layer | Item | Laydown (g/m$^2$) |
|---|---|---|
| Layer 1 | Blue Sensitive Layer | |
| | Gelatin | 1.3127 |
| | Blue sensitive silver (Blue EM-1) | 0.2399 |
| | Y-4 | 0.4143 |
| | ST-23 | 0.4842 |
| | Tributyl Citrate | 0.2179 |
| | ST-24 | 0.1211 |
| | ST-16 | 0.0095 |
| | Sodium Phenylmercaptotetrazole | 0.0001 |
| | Piperidino hexose reductone | 0.0024 |
| | 5-chloro-2-methyl-4-isothiazolin-3-one/2-methyl-4-isothiazolin-3-one(3/1) | 0.0002 |
| | SF-1 | 0.0366 |
| | Potassium chloride | 0.0204 |
| | Dye-1 | 0.0148 |
| Layer 2 | Interlayer | |
| | Gelatin | 0.7532 |
| | ST-4 | 0.1076 |
| | S-3 | 0.1969 |
| | 5-chloro-2-methyl-4-isothiazolin-3-one/2-methyl-4-isothiazolin-3-one(3/1) | 0.0001 |
| | Catechol disulfonate | 0.0323 |
| | SF-1 | 0.0081 |
| Layer 3 | Green Sensitive Layer | |
| | Gelatin | 1.1944 |
| | Green Sensitive Silver (Green EM-1) | 0.1011 |
| | M-4 | 0.2077 |
| | Oleyl Alcohol | 0.2174 |
| | S-3 | 0.1119 |
| | ST-21 | 0.0398 |
| | ST-22 | 0.2841 |
| | Dye-2 | 0.0073 |
| | 5-chloro-2-methyl-4-isothiazolin-3-one/2-methyl-4-isothiazolin-3-one(3/1) | 0.0001 |
| | SF-1 | 0.0236 |
| | Potassium chloride | 0.0204 |
| | Sodium Phenylmercaptotetrazole | 0.0007 |
| Layer 4 | M/C Interlayer | |
| | Gelatin | 0.7532 |
| | ST-4 | 0.1076 |
| | S-3 | 0.1969 |
| | Acrylamide/t-Butylacrylamide sulfonate copolymer | 0.0541 |
| | Bis-vinylsulfonylmethane | 0.1390 |
| | 3,5-Dinitrobenzoic acid | 0.0001 |
| | Citric acid | 0.0007 |
| | Catechol disulfonate | 0.0323 |
| | 5-chloro-2-methyl-4-isothiazolin-3-one/2-methyl-4-isothiazolin-3-one(3/1) | 0.0001 |
| Layer 5 | Red Sensitive Layer | |
| | Gelatin | 1.3558 |
| | Red Sensitive silver (Red EM-1) | 0.1883 |
| | IC-35 | 0.2324 |
| | IC-36 | 0.0258 |
| | UV-2 | 0.3551 |
| | Dibutyl sebacate | 0.4358 |
| | S-6 | 0.1453 |
| | Dye-3 | 0.0229 |
| | Potassium p-toluenethiosulfonate | 0.0026 |
| | 5-chloro-2-methyl-4-isothiazolin-3-one/2-methyl-4-isothiazolin-3-one(3/1) | 0.0001 |
| | Sodium Phenylmercaptotetrazole | 0.0005 |
| | SF-1 | 0.0524 |
| Layer 6 | UV Overcoat | |
| | Gelatin | 0.8231 |
| | UV-1 | 0.0355 |
| | UV-2 | 0.2034 |
| | ST-4 | 0.0655 |
| | SF-1 | 0.0125 |
| | S-6 | 0.0797 |
| | 5-chloro-2-methyl-4-isothiazolin-3-one/2-methyl-4-isothiazolin-3-one(3/1) | 0.0001 |
| Layer 7 | SOC | |
| | Gelatin | 0.6456 |
| | Ludox AM ™ (colloidal silica) | 0.1614 |
| | Polydimethylsiloxane (DC200 ™) | 0.0202 |
| | 5-chloro-2-methyl-4-isothiazolin-3-one/2- | 0.0001 |

-continued

| Layer | Item | Laydown (g/m$^2$) |
|---|---|---|
| | methyl-4-isothiazolin-3-one(3/1) | |
| | SF-2 | 0.0032 |
| | Tergitol 15-S-5 ™ (surfactant) | 0.0020 |
| | SF-1 | 0.0081 |
| | Aerosol OT ™ (surfactant) | 0.0029 |

The 10 mm slit rolls of light sensitive silver halide emulsion coated on the transparent polymer sheet of this example were printed using a digital laser photographic printer. Several test images that contained graphics, text, and images were printed on the photographic material. The printed images were then developed using standard reflective photographic RA-4 wet chemistry. At this point, the image was formed on a transparent polymer sheet.

The structure of the photographic imaging member of this example was as follows:

| |
|---|
| Polypropylene polymer |
| Polyethylene with blue pigment 60 and Hostalux KS |
| Coating Format 1 |

Vacuous Polymer Base:

The production of a vacuous opaque oriented polyester polymer base was a blend of particles of a linear polyester (PET) with 25% by volume of particles of a homopolymer polyolefin (polypropylene), extruding the blend as a polymer film, quenching and biaxially orienting the film by stretching it in mutually perpendicular directions, and heat setting the vacuous polymer base.

Vacuous Polymer Base Used for Example 1

Then PET(#7352 from Eastman Chemicals) was dry blended with Polypropylene("PP", Huntsman P4G2Z-073AX) at 20% by weight and with 5% by weight of a 1 part PET to 1 part $TiO_2$ concentrate (PET 9663 E0002 from Eastman Chemicals). This blend was then dried in a desiccant dryer at 65° C. for 12 hours.

Cast sheets were extruded using a 2½" extruder to extrude the PET/PP/$TiO_2$ blend. The 275° C. meltstream was fed into a 7 inch film extrusion die also heated at 275° C. As the extruded sheet emerged from the die, it was cast onto a quenching roll set at 55° C. The PP in the PET matrix dispersed into globules between 10 and 30 $\mu$ms in size during extrusion. The final dimensions of the continuous cast sheet were 18 cm wide and 1250 $\mu$ms thick. The cast sheet was then stretched at 110° C. first 3.2 times in the X-direction and then 3.4 times in the Y-direction. The stretched sheet was then Heat Set at 150° C.

During stretching voids were initiated around the particles of PP that were dispersed in the cast sheet. These voids grew during stretching and resulted in significant void volume. The resulting density of the stretched vacuous polymer base was 0.6 gm/cc and the thickness was 225 $\mu$m.

Imaging Member:

To construct a photographic reflective print material, the image formed on the transparent polymer sheet was laminated to the vacuous core with a layer of 10 micrometers of acrylic pressure sensitive adhesive. The pressure sensitive adhesive was applied to the vacuous core. The imaged transparent polymer sheet with the image side adjacent to the adhesive was laid on top of the adhesive and pressure was used to attached the sheet and base.

The structure of the laminated photographic element is shown below:

| |
|---|
| Polypropylene |
| Polyethylene with blue pigment 60 and Hostalux KS |
| Developed image |
| Acrylic pressure sensitive adhesive |
| Vacuous Polymer Base |
| Writability/Conductive layer |

EXAMPLE 2

This imaging base was produced the same as example 1 except that the vacuous polymer base was made to a density of 0.3 g/cc.

Vacuous Polymer Base Used for Example 2

This example was formed in the same manner as example 1 except the production of the vacuous was made as follows: The Polypropylene loading was 35% by weight and the stretch temperature was 100° C. The resulting density of the stretched vacuous polymer base was 0.3 gm/cc and the thickness was 450 micrometer.

EXAMPLE 3

Control

The control sample was made as described above except a polyethylene resin photographic paper base was used in place of the vacuous polymer base.

Photographic grade cellulose paper base used in the invention:

Paper base was produced for the invention using a standard fourdrinier paper machine and a blend of mostly bleached hardwood Kraft fibers. The fiber ratio consisted primarily of bleached poplar (38%) and maple/beech (37%) with lesser amounts of birch (18%) and softwood (7%). Fiber length was reduced from 0.73 mm length weighted average as measured by a Kajaani FS-200 to 0.55 mm length using high levels of conical refining and low levels of disc refining. Fiber Lengths from the slurry were measured using a FS-200 Fiber Length Analyzer (Kajaani Automation Inc. ). Energy applied to the fibers is indicated by the total Specific Net Refining Power (SNRP) was 127 KW hr/metric ton. Two conical refiners were used in series to provide the total conical refiners SNRP value. This value was obtained by adding the SNRPs of each conical refiner. Two disc refiners were similarly used in series to provide a total Disk SNRP. Neutral sizing chemical addenda, utilized on a dry weight basis, included alkyl ketene dimer at 0.20% addition, cationic starch (1.0%), polyaminoamide epichlorhydrin (0.50%), polyacrylamide resin (0.18%), diaminostilbene optical brightener (0.20 %), and sodium bicarbonate. Surface sizing using hydroxyethylated starch and sodium chloride was also employed but is not critical to the invention. In the 3$^{rd}$ Dryer section, ratio drying was utilized to provide a moisture bias from the face side to the wire side of the sheet. The face side (emulsion side) of the sheet was then remoisturized with conditioned steam immediately prior calendering. Sheet temperatures were raised to between 76° C. and 93° C. just prior to and during calendering. The paper was then calendered to an apparent density of 1.17. Moisture levels after the calender were 7.0% to 9.0% by weight. Paper base B was produced at a basis weight of 178 g/mm$^2$ and thickness of 0.1524 mm. The paper base for the control was then resin coated on each side. The face side was coated with 26.9 g/m$^2$ of low density (0.917 g/cc) polyethylene containing 12.5% by weight of $TiO_2$ and 21 g/m$^2$ of clear medium density (0.924 g/cc) polyethylene. On the face side a layer of acrylic pressure sensitive adhesive coated to adhere the opaque base to the two-layer biaxially oriented polyolefin sheet to which was coated with a standard photographic light sensitive silver halide emulsion after the image was exposed and developed.

TABLE 1

| Example | Opacity | L* |
|---|---|---|
| Example 1 | 97.3 | 97.6 |
| Example 2 | 99.2 | 98.5 |
| Example 2 (Control) | 94.4 | 93.2 |

As can be seen from the data in table 1, examples 1 and 2 that have a vacuous polymer base have an opacity superior to that of resin coated paper. Having a more opaque base will minimize backprint show through as well as show through from whatever is under the image. Additional the vacuous polymer bases in these example have a much higher L* which make color appear lighter and brighter to the viewer.

What is claimed is:

1. An imaging member comprising a vacuous polymer base having adhered thereto an image formed on a transparent polymer sheet, wherein said vacuous polymer base has a density of less than 0.7 grams/cc and a modulus to density ratio of between 1500 and 4000, wherein said image is in contact with said vacuous polymer base and wherein said vacuous polymer base is substantially free of compatibilizer, wherein said vacuous polymer base further comprises on the surface opposite said image a layer of a low Tg polymer having a Tg of less than 60° C., and wherein said low Tg polymer has indicia embossed thereon.

2. The imaging member of claim 1 wherein said vacuous polymer base has a stiffness of between 50 and 300 millinewtons.

3. The imaging member of claim 1 wherein said vacuous polymer base comprises a composite of polyolefin and polyester having a ratio of polyester to polyolefin of between 5:1 and 11:9 by weight.

4. The imaging member of claim 1 wherein said vacuous polymer base comprises a composite of polyolefin and polyester having a ratio of polyester to polyolefin of between 4:1 and 13:7 by weight.

5. The imaging member of claim 1 wherein said vacuous polymer base has a L* of greater than 93.

6. The imaging member of claim 1 wherein said vacuous polymer base has a spectral transmission of less than 10%.

7. The imaging member of claim 1 wherein said vacuous polymer base further is provided with an adhesion layer on the surface adjacent said image.

8. The imaging member of claim 1 wherein said vacuous polymer base is provided with an integral skin layer adapted for adhesion to said image.

9. The imaging member of claim 8 wherein said integral skin layer comprises a polymer having a Tg of less than 60° C.

10. The imaging member of claim 8 wherein said integral skin layer comprises a polymer having a Tg of between 45 and 55° C.

11. The imaging member of claim 1 wherein said vacuous polymer base further is provided with a conductive surface.

12. The imaging member of claim 1 wherein said vacuous polymer base comprises an integrally extruded conductive skin layer.

13. The imaging member of claim 1 wherein said vacuous polymer base is provided with a polyester skin layer.

14. The imaging member of claim 1 wherein said vacuous polymer base has a surface roughness on the side of said vacuous polymer base opposite to said image of between 0.25 and 2.0 micrometers.

15. The imaging member of claim 1 wherein said vacuous polymer base has a surface in contact with said image having a roughness of less than 0.2 micrometers.

16. The imaging member of claim 1 wherein said vacuous polymer base has a surface in contact with said image having a roughness of between 0.09 and 0.20 micrometers.

17. The imaging member of claim 1 wherein said vacuous polymer base further comprises white pigment.

18. The imaging member of claim 14 wherein said vacuous polymer base on the side opposite said image is provided with roughness without use of additive particles.

19. The imaging member of claim 1 wherein said vacuous polymer base further comprises a magnetic recordable layer integral with said vacuous polymer base on the side opposite said image.

20. The imaging member of claim 1 wherein said vacuous polymer base further comprises a fire retardant material.

21. The imaging member of claim 1 wherein said vacuous polymer base further comprises at least one fire retardant material selected from the group consisting of phosphoric acid esters, aryl phosphates and their alkyl substituted derivatives, phosphorinanes, antimony trioxide, aluminum hydroxide, boron-containing compounds, chlorinated hydrocarbons, chlorinated cycloaliphatics, aromatically bond bromine compounds and halogen-containing materials.

22. The imaging member of claim 1 wherein said image adhered to a polymer sheet is adhered to both sides of said vacuous sheet.

23. The imaging member of claim 22 wherein said image adhered to a polymer sheet is wrapped around an edge of said vacuous polymer sheet.

24. The imaging member of claim 23 wherein said imaging member is provided with means to aid insertion into an album.

25. The imaging member of claim 24 wherein said means to aid insertion comprise holes.

26. The imaging member of claim 22 wherein said vacuous polymer base is provided on each side with an integral skin layer adapted for adhesion to said image.

27. The imaging member of claim 26 wherein said integral skin layers comprise a polymer having a Tg of less than 60° C.

28. The imaging member of claim 1 wherein vacuous polymer base has a density of between 0.3 and 0.7 grams/cc.

29. The imaging member of claim 1 wherein said vacuous polymer base is provided with an ink jet receiving layer on the side of said vacuous polymer base opposite to said image.

30. The imaging member of claim 29 wherein said ink jet receiving layer comprises voided polyester.

31. The imaging member of claim 1 wherein said image adhered to a transparent polymer sheet comprises an image formed utilizing photosensitive silver halide and dye forming couplers.

32. The imaging member of claim 1 wherein said image adhered to a transparent polymer sheet comprises an image formed by ink jet printing.

33. The imaging member of claim 1 wherein said image adhered to a transparent polymer sheet comprises an image formed by thermal dye transfer.

34. The imaging member of claim 1 wherein said vacuous polymer base has a density of between 0.3 and 0.5 gm/cc.

35. An imaging member comprising a vacuous polymer base having adhered thereto an image formed on a transparent polymer sheet, wherein said vacuous polymer base has a density of less than 0.7 grams/cc and a modulus to density ratio of between 1500 and 4000 wherein said image is in contact with said vacuous polymer base, wherein said vacuous polymer base is substantially free of compatibilizer, and wherein said vacuous polymer base further comprises a fire retardant material.

36. The imaging member of claim 35 wherein said vacuous polymer base has a stiffness of between 50 and 300 millinewtons.

37. The imaging member of claim 35 wherein said vacuous polymer base comprises a composite of polyolefin and polyester having a ratio of polyester to polyolefin of between 4:1 and 13:7 by weight.

38. The imaging member of claim 35 wherein said vacuous polymer base has a L* of greater than 93.

39. The imaging member of claim 35 wherein said vacuous polymer base further is provided with an adhesion layer on the surface adjacent said image.

40. The imaging member of claim 35 wherein said vacuous polymer base is provided with an integral skin layer adapted for adhesion to said image.

41. The imaging member of claim 40 wherein said integral skin layer comprises a polymer having a Tg of less than 60° C.

42. The imaging member of claim 40 wherein said integral skin layer comprises a polymer having a Tg of between 45 and 55° C.

43. The imaging member of claim 35 wherein said vacuous polymer base further is provided with a conductive surface.

44. The imaging member of claim 35 wherein said vacuous polymer base comprises an integrally extruded conductive skin layer.

45. The imaging member of claim 35 wherein said vacuous polymer base is provided with a polyester skin layer.

46. The imaging member of claim 35 wherein said vacuous polymer base has a surface roughness on the side of said vacuous polymer base opposite to said image of between 0.25 and 2.0 micrometers.

47. The imaging member of claim 35 wherein said vacuous polymer base has a surface in contact with said image having a roughness of between 0.09 and 0.20 micrometers.

48. The imaging member of claim 35 wherein said vacuous polymer base further comprises white pigment.

49. The imaging member of claim 46 wherein said vacuous polymer base on the side opposite said image is provided with roughness without use of additive particles.

50. The imaging member of claim 48 wherein said vacuous polymer base further comprises on the surface opposite said image a layer of a low Tg polymer having a Tg of less than 60° C.

51. The imaging member of claim 50 wherein said low Tg polymer has indicia embossed thereon.

52. The imaging member of claim 35 wherein said vacuous polymer base further comprises at least one fire retardant material selected from the group consisting of phosphoric acid esters, aryl phosphates and their alkyl substituted derivatives, phosphorinanes, antimony trioxide, aluminum hydroxide, boron-containing compounds, chlorinated hydrocarbons, chlorinated cycloaliphatics, aromatically bond bromine compounds and halogen-containing materials.

53. The imaging member of claim 35 wherein said image adhered to a polymer sheet is adhered to both sides of said vacuous sheet.

54. The imaging member of claim 53 wherein said image adhered to a polymer sheet is wrapped around an edge of said vacuous polymer sheet.

55. The imaging member of claim 53 wherein said vacuous polymer base is provided on each side with an integral skin layer adapted for adhesion to said image.

56. The imaging member of claim 35 wherein vacuous polymer base has a density of between 0.3 and 0.7 grams/cc.

57. The imaging member of claim 35 wherein said vacuous polymer base is provided with an ink jet receiving layer on the side of said vacuous polymer base opposite to said image.

58. The imaging member of claim 57 wherein said ink jet receiving layer comprises voided polyester.

59. The imaging member of claim 35 wherein said image adhered to a transparent polymer sheet comprises an image formed utilizing photosensitive silver halide and dye forming couplers.

60. The imaging member of claim 35 wherein said image adhered to a transparent polymer sheet comprises an image formed by ink jet printing.

61. The imaging member of claim 35 wherein said image adhered to a transparent polymer sheet comprises an image formed by thermal dye transfer.

* * * * *